US005783800A

United States Patent [19]

Thompson et al.

[11] Patent Number: 5,783,800

[45] Date of Patent: Jul. 21, 1998

[54] HAIR BRAIDING TOOL WITH MATING SEMI-CYLINDRICAL GROOVE PAIRS HAVING DIFFERENT SIZES

[76] Inventors: Ivan C. Thompson, 13450 Buchanan Dr., Ft. Washington, Md. 20744; Henry Dawson, 11821 Duley Station Rd., Upper Marlboro, Md. 20772; Lisa L. Little, 3500 Briarwood Dr., #33 Dumfries, Va. 22026

[21] Appl. No.: 689,564

[22] Filed: Aug. 12, 1996

[51] Int. Cl.[6] ..... A45D 26/00; H05B 1/00

[52] U.S. Cl. ..... 219/225; 219/223; 219/227; 30/140; 30/254; 132/201; 132/225; 132/269

[58] Field of Search ..... 219/225, 221, 219/227, 228, 229, 230, 524, 535, 223; 132/225, 224, 269, 201; 606/27–31; 30/140, 254; 126/226; 425/12, DIG. 13; 294/99.2, 106

[56] References Cited

U.S. PATENT DOCUMENTS

| | | | |
|---|---|---|---|
| 1,455,696 | 5/1923 | Wright | 219/225 |
| 1,465,838 | 8/1923 | Caneavri | 219/225 |
| 2,133,163 | 10/1938 | Decker | 219/225 |
| 2,447,960 | 8/1948 | Ricketts et al. | 219/524 |
| 2,474,147 | 6/1949 | Hill et al. | 219/225 |
| 3,610,258 | 10/1971 | Van Droogenbroeck | 132/269 |
| 3,980,861 | 9/1976 | Fukunaga | 219/230 |
| 4,662,068 | 5/1987 | Polonsky | 606/28 |
| 4,967,059 | 10/1990 | Wagner | 219/230 |
| 5,472,654 | 12/1995 | Crawford | 219/223 |

FOREIGN PATENT DOCUMENTS

| | | | |
|---|---|---|---|
| 4106705 | 9/1991 | Germany | 219/227 |

*Primary Examiner*—John A. Jeffery

*Attorney, Agent, or Firm*—Sughrue, Mion, Zinn, Macpeak & Seas, PLLC

[57] ABSTRACT

A hair braiding tool for fusing the end of a braid of synthetic fibers includes a first elongated member having at least one substantially semi-cylindrical transverse groove formed in a surface thereof with the groove having an open end and a closed end and a second elongated member pivotally connected to the first elongated member and having at least one substantially semi-cylindrical transverse groove formed in a surface thereof with the groove having an open end and a closed end. Upon bringing the first and second members into engagement with each other, the semi-cylindrical grooves therein mate with each other to define a cylindrical passage having an open end and a closed end for receiving a braid end therein. An electrical heating element is disposed in contact with the closed end of the cylindrical passage for trimming and fusing the braid end.

5 Claims, 3 Drawing Sheets

HAIR BRAIDING TOOL WITH MATING SEMI-CYLINDRICAL GROOVE PAIRS HAVING DIFFERENT SIZES

BACKGROUND OF THE INVENTION

The present invention is directed to a hair braiding tool and more specifically to a heated tool for crimping, severing and fusing hair braid extenders comprised of synthetic filaments. Traditionally, women with extremely long hair would braid the hair into one or two long braids which extended a substantial distance down the woman's back. In recent years it has become much more popular to decoratively braid a woman's hair into a plurality of tight rows generally known as "corn rows". Another popular style is to braid all of a woman's hair into a plurality of braids which would cover the entire head. Since many women who like this hair style do not have extremely long hair, it has become a common practice to extend the length of the braids by the use of synthetic filaments such as nylon. The nylon filaments would be braided with the natural hair near the end of the natural hair braid and then continue the length of the braid a substantial distance further using only synthetic fibers or filaments.

In order to finish off the end of each braid in a neat, compact manner, it has become a common practice to fuse the fibers or filaments at the end of each braid by the application of heat. The most common way of fusing the synthetic filaments is to merely place the end of the braid in an open flame to melt the ends of the filaments and fuse them together. Even after the filaments have been melted, it is still necessary for the hairdresser to roll the ends of the braids between her fingers to provide a compact, neat finished end on the braid. Thus the operator's fingers would frequently become burned due to the high residual heat still present in the melted filaments since it was necessary to press the filaments together while they were still soft from the heat. Although several attempts have been made to use electric heating irons to melt the ends of the synthetic filaments instead of an open flame, it is still necessary to press or roll the filaments together to form a neat finished end on the braid.

SUMMARY OF THE INVENTION

The present invention provides a new and improved hair braiding tool which facilitates the fusing of the synthetic fibers which have been braided to prevent unraveling of the braid and at the same time, sever any fibers extending beyond the desired end of the braid while pressing the fibers into a compact, substantially cylindrical braid end.

The present invention provides a new and improved hair braiding tool for fusing the end of a braid of synthetic fibers comprising a first elongated member having at least one substantially semi-cylindrical transverse groove formed in a surface thereof with the groove having an open end and a closed end, a second elongated member pivotally connected to the first elongated member and having at least one substantially semi-cylindrical transverse groove formed in a surface thereof with the groove having an open end and a closed end, said semi-cylindrical groove in said second elongated member being complementary to said semi-cylindrical groove in said first elongated member so that when the surfaces of said first and second members are brought into engagement, a cylindrical passage is formed having an open end and a closed end for receiving a braid end therein and heating means are provided for heating the closed end of the cylindrical passage for trimming and fusing the braid end.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE INVENTION

Figure 4:
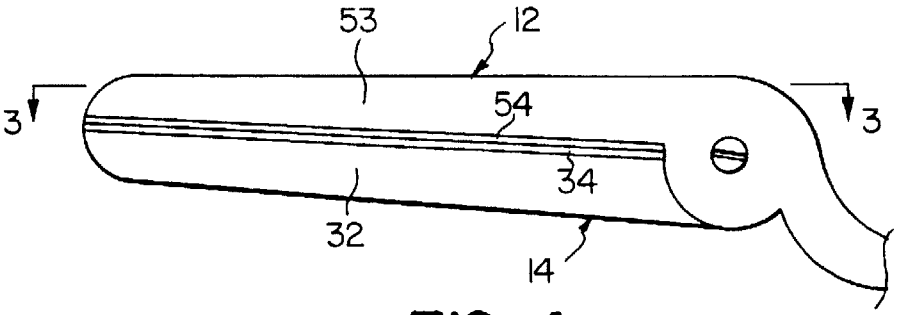
FIG. 4 is a side elevation view of the hair tool in the closed condition.

The hair braiding tool according to the present invention is designed for compression, fusing and trimming the ends of synthetic hair braids of different diameters and is comprised of a pair of elongated braid gripping members 12 and 14 pivoted together at one end by means of a pivot member 16. Each braid gripping member 12 and 14 has an elongated handle 18 and 20 respectively integrally connected thereto wherein upon squeezing the handle member 18 and 20 together, the braid gripping members 12 and 14 will be brought together in mating condition along the entire length thereof, as shown in FIGS. 1 and 4.

Figure 2:
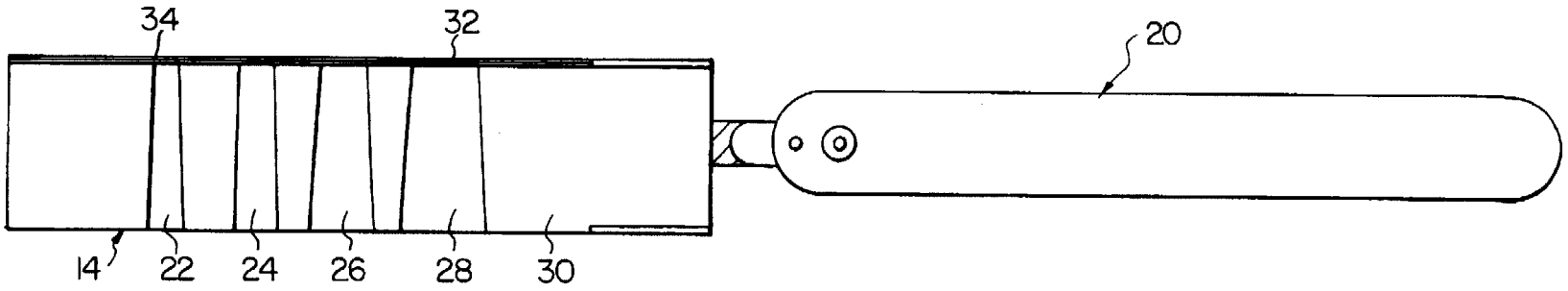
FIG. 2 is a plan view of the tool shown in FIG. 1 with the upper elongated member broken away to expose the semi-cylindrical grooves in the lower member.
Figure 3:
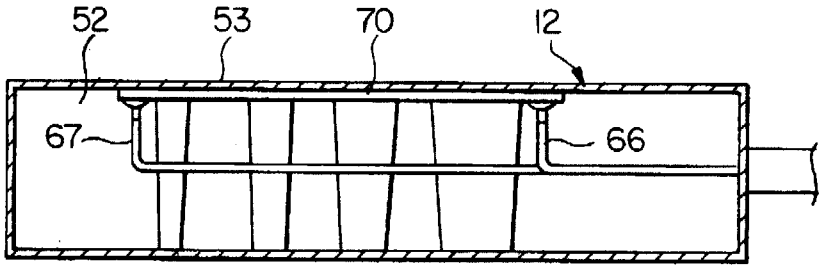
FIG. 3 is a sectional view taken along the line 3—3 in FIG. 4.

The opposed surfaces of the braid gripping members 12 and 14 are each provided with a plurality of transverse, semi-cylindrical grooves which are tapered along the length thereof from one side of the member to the other. As shown in FIG. 2, the grooves 22, 24, 26 and 28 are formed in the flat, mating surface 30 of the member 14. The grooves vary in average diameter from the smallest 22 to the largest 28 and are open at one end and closed at the opposite end by a wall 32 which is tapered to a relatively sharp edge 34, which constitutes a braid severing blade.

Figure 1:
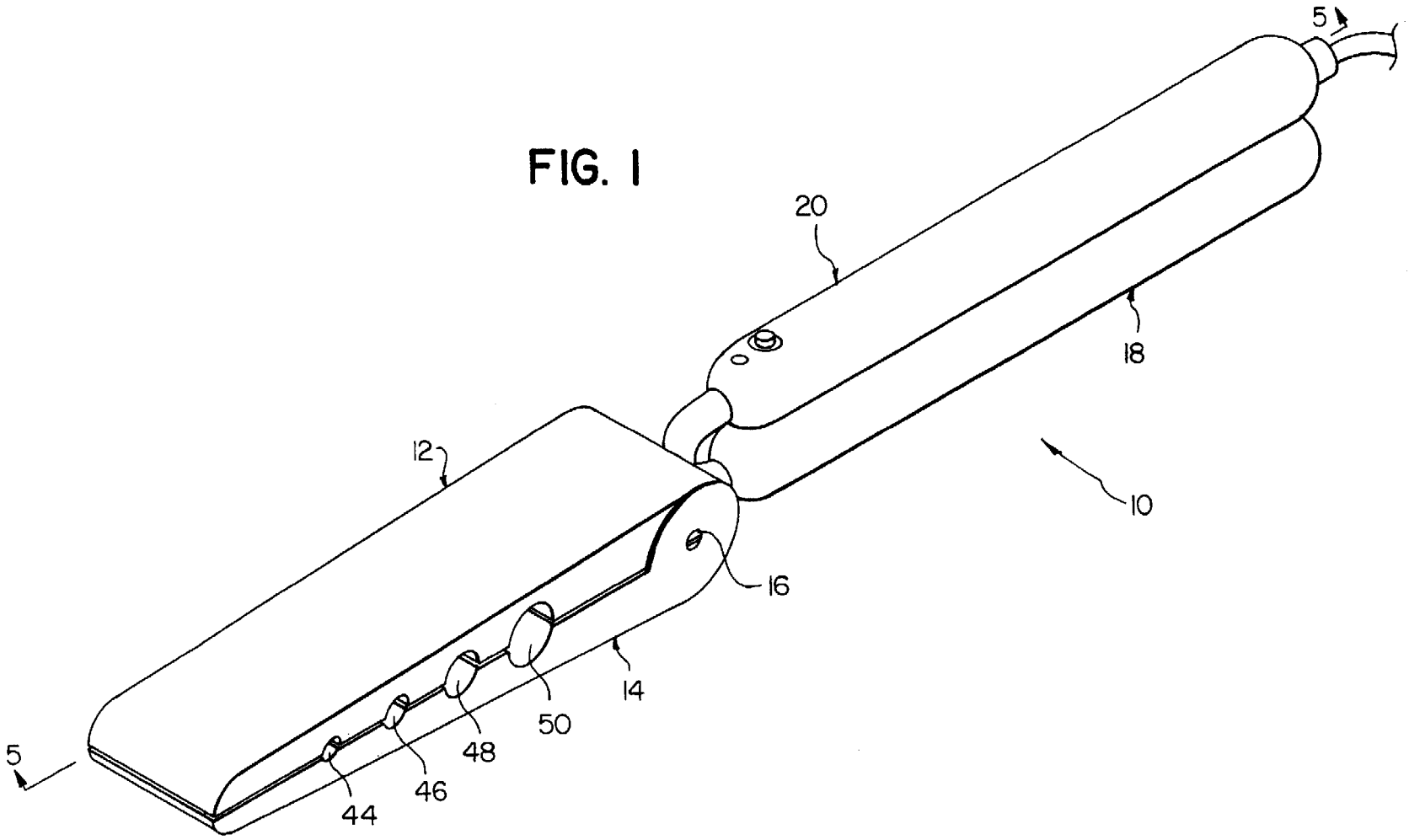
FIG. 1 is a perspective view of the hair braiding tool in the closed condition.

The braid clamping member 12 has a substantially identical construction to the braid clamping member 14 and is provided with a plurality of semi-cylindrical transversely extending tapered grooves 36, 38, 40 and 42, which are complementary to the grooves, 22, 24, 26 and 28, respectively in the member 14 to define a plurality of tapered cylindrical passages 44, 46, 48 and 50 when the surfaces 30 and 52 of the members 14 and 12 are pivoted into mating engagement as shown in FIG. 1. Each of the semi-cylindrical tapered grooves 36, 38, 40 and 42 are open at one end and closed at the opposite end by means of a wall extending the length of the member 12 which constitutes a blade 54 which mates with the blade 34 for the purpose of severing the end of the braid which is located in a respective passage.

In order to compress, fuse and sever the end of a synthetic hair braid located in a selected passage, the blades 34 and 54, as well as the ends of the passages 44, 46, 48 and 50, adjacent the blades 34 and 54, are heated to the required temperature for severing and fusing the synthetic hair fibers. Each of the braid clamping members 12 and 14, as well as the respective handles, 18 and 20, are hollow to permit the passage of electrical wires. An electrical wire is led into the hollow handle 20 by means of a conventional fitting 62 secured to the end of the handle. The wire 60 is connected to a switch 64 which controls the flow of current to a first pair of wires 66 and 67 which extend into the member 12 and a pair of wires 68 and 69 which extend into the member 14. The ends of the wires 66 and 67 are connected to a heating element 70 which is disposed along the junction between the walls 52 and 53 in contact with both walls. Thus, the heating element 70 extends over the narrow end of each semi-cylindrical groove 36, 38, 40 and 42 so that upon the flow of current through the heating element, the narrow ends of the grooves 36, 38, 40 and 42 will be heated as well as the blade 54 which closes the end of each groove.

In a similar manner, an electrically conductive heating element 72 is disposed along the intersection between the walls 30 and 32 of the braid gripping member 14. Thus, upon the flow of current through the heating element 72, the narrow ends of the semi-cylindrical grooves 22, 24, 26 and 28 will be heated as well as the blade 34.

Figure 5:
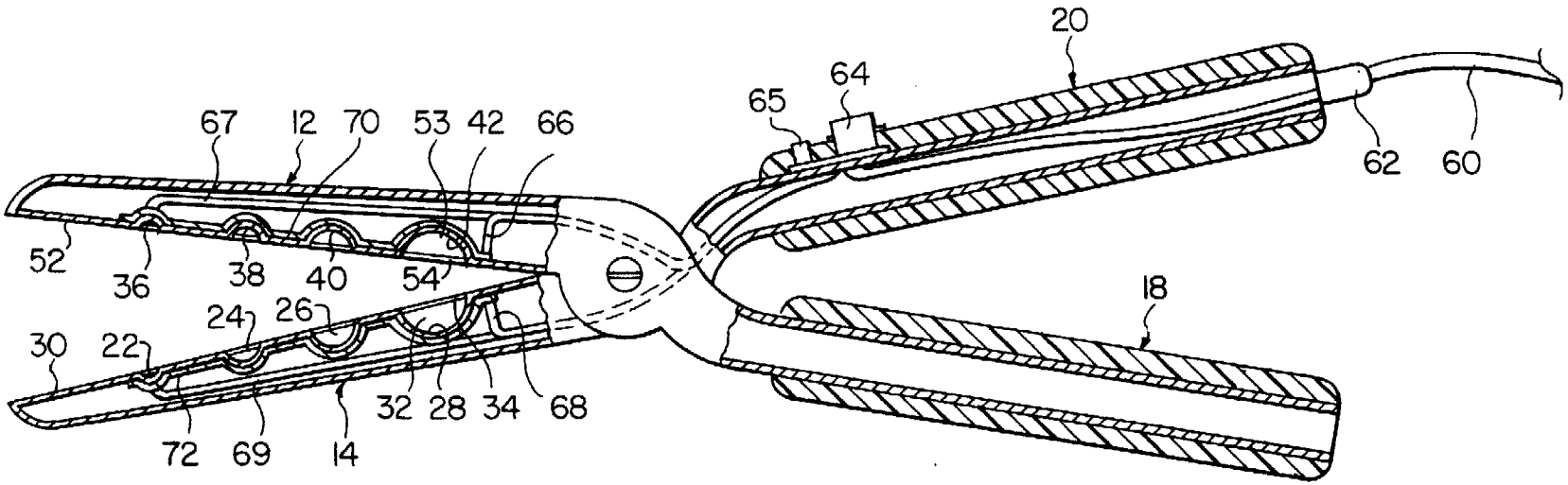
FIG. 5 is a sectional view of the braiding tool taken along the line 5—5 in FIG. 1.

When the synthetic hair braid extender is braided to the desired length, the hair braiding tool according to the present invention may be used to finish off the end of the braid. The end of the braid is disposed in a suitable semi-cylindrical recess in the lower braid clamping member 14 as viewed in FIG. 5, depending upon the thickness of the braid end, with any excess length of fibers extending over the blade 34. The braid clamping members 12 and 14 are then pivoted to bring the walls or faces 52 and 30 into engagement with each other, thereby clamping and compressing the end of the braid in the selected tapered cylindrical passage 44, 46, 48 or 50. The excess length of synthetic fibers will be clamped between the blades 34 and 54. Upon operation of the switch 64, the electric current will be supplied to both heating elements 70 and 72. The flow of current will be indicated by the pilot light 65. Thus, the blades 34 and 54 will be heated to sever the excess length of fibers from the end of the braid and the narrow ends of the selected passage walls will also be heated to fuse the compressed end of the braid so that the braid will not subsequently unravel. Suitable temperature indicators can be provided on the members 12 and 14 to let the operator know when the temperature of the blades and the recess walls have reached the desired temperature. A suitable thermostatic control could also be provided for limiting the temperature of the heating elements 70 and 72. It is also possible for a skilled operator to judge the length of time necessary to hold the end of the braid clamped in the hair braiding tool with the current flowing through the heating elements 70 and 72.

The body of each clamping member 12 and 14 may be constructed of any suitable material with at least the walls 32 and 53 and the walls constituting the clamping surfaces 52 and 30 being made of heat conductive material which is capable of being heated to the required temperature for fusing the braid without any adverse affects to the material. The semi-cylindrical grooves and the blades at the end thereof may be coated with any suitable non-stick material such as Teflon or the like.

The heating elements 70 and 72 have been shown as a simple wire laid along the junction between the walls adjacent the narrow ends of the grooves but any other suitable heating element could be provided. If it was desired to heat a greater portion or the entire length of the groove or passage, a heating element of appropriate length extending along the grooves or passages could be provided.

The fiber severing blades 34 and 54 are designed to mate in edge to edge contact which is sufficient with the applied heat to sever the fibers. However, if absolutely necessary, the blades 34 and 54 could be designed to slightly overlap each other with a shearing effect similar to scissors to facilitate the severing of the fibers. The synthetic hair braid extenders are generally formed from polyester or nylon fibers but any other suitable fibers could be utilized. Thus the desired fusing and severing temperature will vary depending upon the specific fibers chosen for the braid extender.

While the invention has been particularly shown and described with reference to preferred embodiments thereof, it will be understood by those in the art that the foregoing and other changes in form and details may be made therein without departing from the spirit and scope of the invention.

What is claimed is:

1. A hair braiding tool comprising first and second members, each of said members having at least one substantially semi-cylindrical groove therein, said grooves each having a closed end defined by a blade, said grooves and said blades being complementary to each other when disposed in mating relation to define at least one passage having a closed end and an open end for receiving an end of a synthetic hair braid and heating means for heating said grooves and said blades to fuse said end to prevent unraveling of the braid.

2. A hair braiding tool as set forth in claim 1, further comprising pivot means for connecting said members to each other to open and close said passage.

3. A hair braiding tool as set forth in claim 2, wherein each member has an elongated flat surface with each surface having a plurality of substantially semi-cylindrical grooves of different diameters extending transversely of said surface parallel to each other with one end of each groove being closed by a blade, said semi-cylindrical grooves and said blades in said first member being complementary to said semi-cylindrical grooves and said blades in said second member, respectively, whereby upon pivoting of said members to bring said semi-cylindrical grooves and said blades into mating relation, a plurality of substantially cylindrical passages of different diameters which are closed at one end are formed.

4. A hair braiding tool as set forth in claim 3, wherein said blades on the first member engage the blades on the second member when said semi-cylindrical grooves are brought into mating engagement with each other to sever excess synthetic hair at said end of said synthetic hair braid.

5. A hair braiding tool as set forth in claim 4, wherein said heating means are comprised of a heating element disposed in contact with each of aid grooves and said blades and electrical circuit means connected to said heating elements including switch means for controlling the flow of current through said heating elements.

* * * * *